United States Patent [19]

Blecher et al.

[11] Patent Number: 4,669,133

[45] Date of Patent: Jun. 2, 1987

[54] APRON FOR BATHTUBS

[75] Inventors: Klaus Blecher, Hardegsen; Reinhard Fiedler, Waldeck; Hubert Beermann, Hardegsen; Gerhard Wagener, Edertal-Bergheim, all of Fed. Rep. of Germany

[73] Assignee: Correcta GmbH, Fed. Rep. of Germany

[21] Appl. No.: 833,130

[22] Filed: Feb. 24, 1986

Related U.S. Application Data

[63] Continuation of Ser. No. 637,977, Aug. 6, 1984, abandoned.

[30] Foreign Application Priority Data

Aug. 17, 1983 [DE] Fed. Rep. of Germany ..... 3329649

[51] Int. Cl.[4] ..... A47K 3/02

[52] U.S. Cl. ..... 4/538; 4/584; 4/592

[58] Field of Search ..... 4/538, 585, 584, 594, 4/592, 593

[56] References Cited

U.S. PATENT DOCUMENTS

| | | | |
|---|---|---|---|
| D. 143,767 | 2/1946 | Stanitz | 4/538 X |
| D. 177,076 | 3/1956 | Stanitz | 4/538 X |
| 2,695,256 | 11/1954 | De Ollogui et al. | 4/538 |
| 2,967,309 | 1/1961 | Corp | 4/538 X |

FOREIGN PATENT DOCUMENTS

| | | | |
|---|---|---|---|
| 32681 | 3/1980 | Japan | 4/538 |

*Primary Examiner*—Henry K. Artis

*Attorney, Agent, or Firm*—Connolly and Hutz

[57] ABSTRACT

For facing a bathtube, an apron (3) of foam plastic is hooked into the tub edge (5) and secured to the adjoining structural elements (1, 20), in particular by means of assembly foam which, after introduction into the openings (9, 11), swells out through openings in the end face.

7 Claims, 2 Drawing Figures

APRON FOR BATHTUBS

CROSS REFERENCE TO RELATED APPLICATION

This application is a continuation of application Ser. No. 637,977 filed Aug. 6, 1984, now abandoned.

This invention relates to a foam-plastic apron for bathtubs.

When a bathtub or shower cubicle is installed in a building, it is standard practice to cover the sides visible from the bathroom with an apron for aesthetic and hygienic reasons.

One known apron is built up like brickwork from individual Styropor blocks.

The disadvantage of this construction lies in the fact that it is labor-intensive and requires skill to assemble because the outer surface of the apron has to be completely flat for the usual tile finish.

There are also foam-plastic aprons which are fixed to a metal frame.

In their case, the loads applied to the foam panels are transmitted through the frame into the floor, as a result of which thermal stressing also occurs due to the different expansion coefficients of steel and plastic. In addition, the steel components are in danger of rusting, particularly if they are not carefully treated. At the same time, the metal components transmit sound and heat which is undesirable. In addition, a steel frame is very expensive and more difficult to adapt in cases of differing dimensions.

The object of the present invention is to provide a dimensionally adaptable, quickly fitted apron which, in addition to adequate rigidity, provides effective insulation against sound and heat and also forms a flat substrate for the facing (for example in the form of tiles) applied before or after installation.

According to the invention, this object is achieved in that a sheet-form material is directly connected as apron to the underneath of the edge of the bathtub and to the floor of the building, at least on one visible side of the bathtub, by means of connections.

It is surprising that the limited thickness of the foam-plastic sheet attributable to the confined spatial conditions provides sufficient rigidity, even in the event of laterally applied forces (for example knee pressure), for even sensitive coverings, such as tiles for example, not to be removed. The sheet-form material, which may consist of a flat sheet of PUR or polystyrene foam, provides effective insulation against body noise and heat flow. Another advantage lies in the fact that the sheet, which generally extends over an entire side, may be cut to the necessary size with an ordinary knife and may be fitted in a few simple steps. It is also possible to provide the outside surface of the sheet with markings to facilitate exact application of the tiles or directly to apply the final covering (for example a film) on the work side.

In one particular embodiment, the sheet-form material is provided along its edge with a shoulder.

Sheet-form materials formed for example with a flange in the form of a shoulder along their upper edge may simply be hooked as it were into baths having an inwardly angled edge by inclination on introduction and then turned into their final position. To prevent the apron from sliding out, individual tabs may also be provided as lugs on what will ultimately be the inner side of the apron, jamming tightly against the outside of the bathtub when the apron is turned into position. To prevent it from being cut or from breaking off, the flange may be provided with a reinforcement (protective film).

In another embodiment, the flange is resilient.

A tongue in the form of a resilient flange along the edge of the sheet affords the advantage that alignment is made easier and differences in size can be neutralized.

In one preferred embodiment, the sheet form material is provided with reinforcements. Reinforcements can be applied in the form of ribs. However, it would also be possible to apply or incorporate a fabric. Finally, plastic or metal components could be incorporated in elongate form or at individual points. Whatever its form, the function of the reinforcement is to increase the strength of the sheet-form material.

In another embodiment, recessed open at least to the end face of the sheet-form material are provided for the connections.

Through these recesses, which accommodate the actual fastening (connection), it is possible on the one hand to bring the rest of the apron up to the adjoining structural elements and on the other hand to enable the connections to end flush with the outside of the bathtub apron to enable the covering to be better applied.

In one possible embodiment, the recesses consist of a continuous groove along the edge of the sheet-form material.

This groove, which may be made thicker on one side to facilitate insertion and holding of the connection, fixes the sheet-form material over its entire length, which is particularly recommendable in the base region (on the floor).

In one special embodiment, the recesses consist of individual open hollow chambers with an overflow.

A hardening swelling agent may be introduced into these hollow chambers by laterally piercing the wall with a nozzle and, by foaming at the end face, establishes a connection with the counter-member, the residual material being able to flow off laterally through an overflow after the hollow chambers have been filled and, if desired, being used for additional lateral fastening.

In one improved embodiment, the connection consists of foam plastic.

A polyurethane foam of the type used for example as an assembly foam with a hardening time of 10 to 20 minutes has proved to be particularly effective for fastening.

In one embodiment, the connection consists of mechanically fixable elements.

It is also possible to obtain satisfactory fastening using wedges, vertically adjustable screws or eccentric discs.

Examples of the invention are described in detail in the following with reference to the accompanying drawings, wherein.

Figure 1:
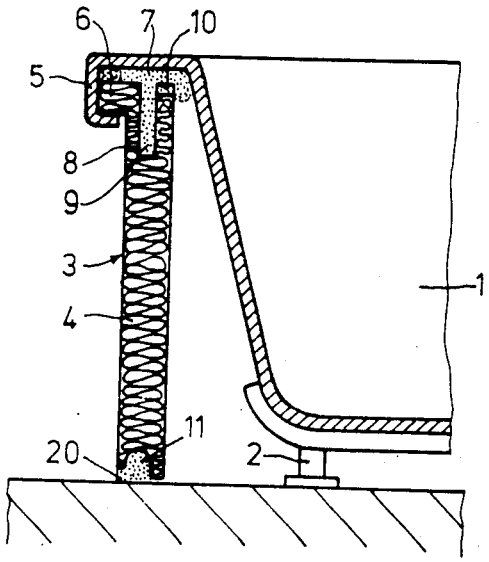
FIG. 1 is a section through a bathtub with an apron.

FIG. 1 shows a bathtub 1 on feet 2. In this case, the apron 3 of the bathtub consists of a sheet-form material 4 in the form of a panel with an upper shoulder 6 wedged behind the triple-angled edge 5 of the bathtub and arranged as a flange at a right-angle to the panel 4. The upper connection 7 between the bathtub 1 and the panel 4 is established by a foam plastic which has penetrated through the opening 8 on completion of the foaming reaction into the hollow chamber 9, in the form of a short recess open to the end face, with an overflow 10 up to the edge 5 of the bathtub. At the lower end of the panel, a recess in the form of a continuous groove 11 in the end face 12 of the panel 4, in conjunction with the PUR foam plastic connection 7 enables the apron 3 to be fixed to the floor over its entire length.

Figure 2:
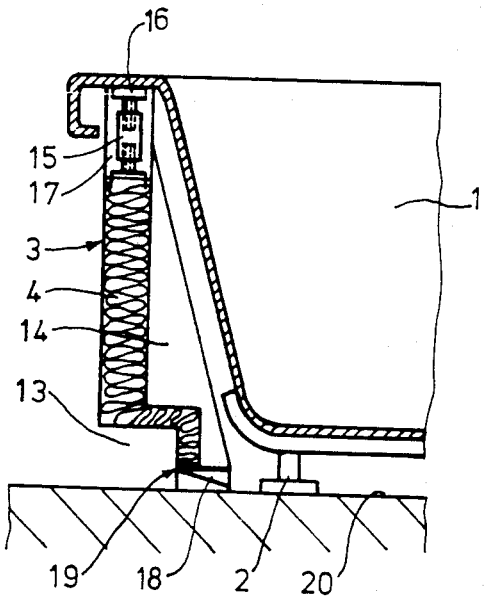
FIG. 2 is a section through a bathtub with an apron and a foot recess.

In FIG. 2, a bathtub 1 on feet 2 is provided with an apron 3 of a sheet-form material 4 which comprises a foot recess 13 and, for reinforcement, individual stiffening ribs 14. The upper connection 7 consists of a vertically adjustable screw 15 with an upper suction cup 16 in a recess 17. The lower connection 7 consists of wedges 18 inserted through lateral openings 19.

The construction according to the invention is of course also applicable to shower cubicles or other structural elements which have to be provided with a facing (ducts), in which case the sheet-form materials may even be joined together where they meet.

We claim:

1. A bathtub apron that extends between an upper tub edge and a tub support surface comprising a unit of foam plastic material having heat and sound insulation properties, a flat facing on an outside surface of the foam plastic unit, and means at the upper and lower edges of the foam plastic unit for attaching it in place between an upper tub edge and a tub support surface, the means including foam plastic introduced in situ adhering between the upper edge of the unit and the upper tub edge and also adhering between the lower edge of the unit and the tub support surface said upper and lower edges of the foam plastic unit include recesses along the length thereof filled with the foam plastic introduced in situ adhering between the upper edge of the unit and upper tub edge and also adhering between the lower edge of the unit and the tub support surface wherein a connection is established between, the upper tub edge, the bathtub apron and the support surface.

2. A bathtub apron as in claim 1 wherein the foam plastic unit includes an outwardly extending shoulder at the upper end thereof constructed and arranged to complement the inside surface of the upper tub edge.

3. A bathtub apron as in claim 2 wherein the shoulder is resilient.

4. A bathtub apron as in claim 1 including reinforcement means on an inside surface of the foam plastic unit.

5. A bathtub apron as in claim 1 wherein the recesses are in the form of a continuous groove.

6. A bathtub apron as in claim 5 including an overflow portion next to the continuous groove at the upper edge of the foam plastic unit whereby excess foam plastic introduced in situ may exit the groove.

7. A bathtub apron as in claim 1 wherein the foam plastic introduced in situ comprises polyurethane.

* * * * *